US006385981B1

(12) United States Patent
Vaisman

(10) Patent No.: US 6,385,981 B1
(45) Date of Patent: May 14, 2002

(54) CAPACITY CONTROL OF REFRIGERATION SYSTEMS

(75) Inventor: Igor Vaisman, Thornhill (CA)

(73) Assignee: Mobile Climate Control Industries Inc.

( * ) Notice: Subject to any disclaimer, the term of this patent is extended or adjusted under 35 U.S.C. 154(b) by 0 days.

(21) Appl. No.: 09/882,074

(22) Filed: Jun. 18, 2001

Related U.S. Application Data

(63) Continuation-in-part of application No. 09/526,453, filed on Mar. 16, 2000.

(51) Int. Cl.[7] ..... F25B 41/00; F25B 49/00

(52) U.S. Cl. ..... 62/196.3; 62/222; 62/228.3; 62/513

(58) Field of Search ..... 62/196.1, 196.3, 62/197, 228.1, 228.3, 228.5, 513, 113, 217, 222; 417/295, 213, 292, 297, 310, 440

(56) References Cited

U.S. PATENT DOCUMENTS 4,727,725 A * 3/1988 Nagata et al. ..... 62/196.3
5,167,130 A * 12/1992 Morris et al. ..... 62/196.1
5,603,227 A * 2/1997 Holden et al. ..... 62/193
5,775,117 A * 7/1998 Shaw ..... 62/196.3
5,899,091 A * 5/1999 Fraser, Jr. et al. ..... 62/473
5,996,364 A * 12/1999 Lifson et al. ..... 62/196.1
6,047,556 A * 4/2000 Lifson ..... 62/196.12
6,058,727 A * 5/2000 Fraser, Jr. et al. ..... 62/190
6,058,729 A * 5/2000 Lifson et al. ..... 62/217
6,122,924 A * 9/2000 Lifson et al. ..... 62/192
6,138,467 A * 10/2000 Lifson et al. ..... 62/217
6,202,438 B1 * 3/2001 Barito ..... 62/513

* cited by examiner

*Primary Examiner*—Denise L. Esquivel
*Assistant Examiner*—Marc Norman

(57) ABSTRACT

The present invention is directed to a method of reducing cooling capacity in refrigeration systems. The present invention provides a refrigeration system comprising a main, an economizing, and a bypass circuits. The main circuit comprises a compressor, a condenser unit, an expansion device, an evaporator unit, connecting piping and appropriate refrigeration control. The compressor includes an economizer port located in the compression region, and a variable flow valve associated with the economizer port. A body of the valve is a part of a body of the housing and a seat of the valve in a closed position is shaped to be contiguous with internal portion of the housing. The economizer circuit includes a first solenoid valve, an additional expansion device and an economizing heat exchanger. The bypass circuit has a second solenoid valve. A control system activates the valves based on a capacity demand.

27 Claims, 1 Drawing Sheet

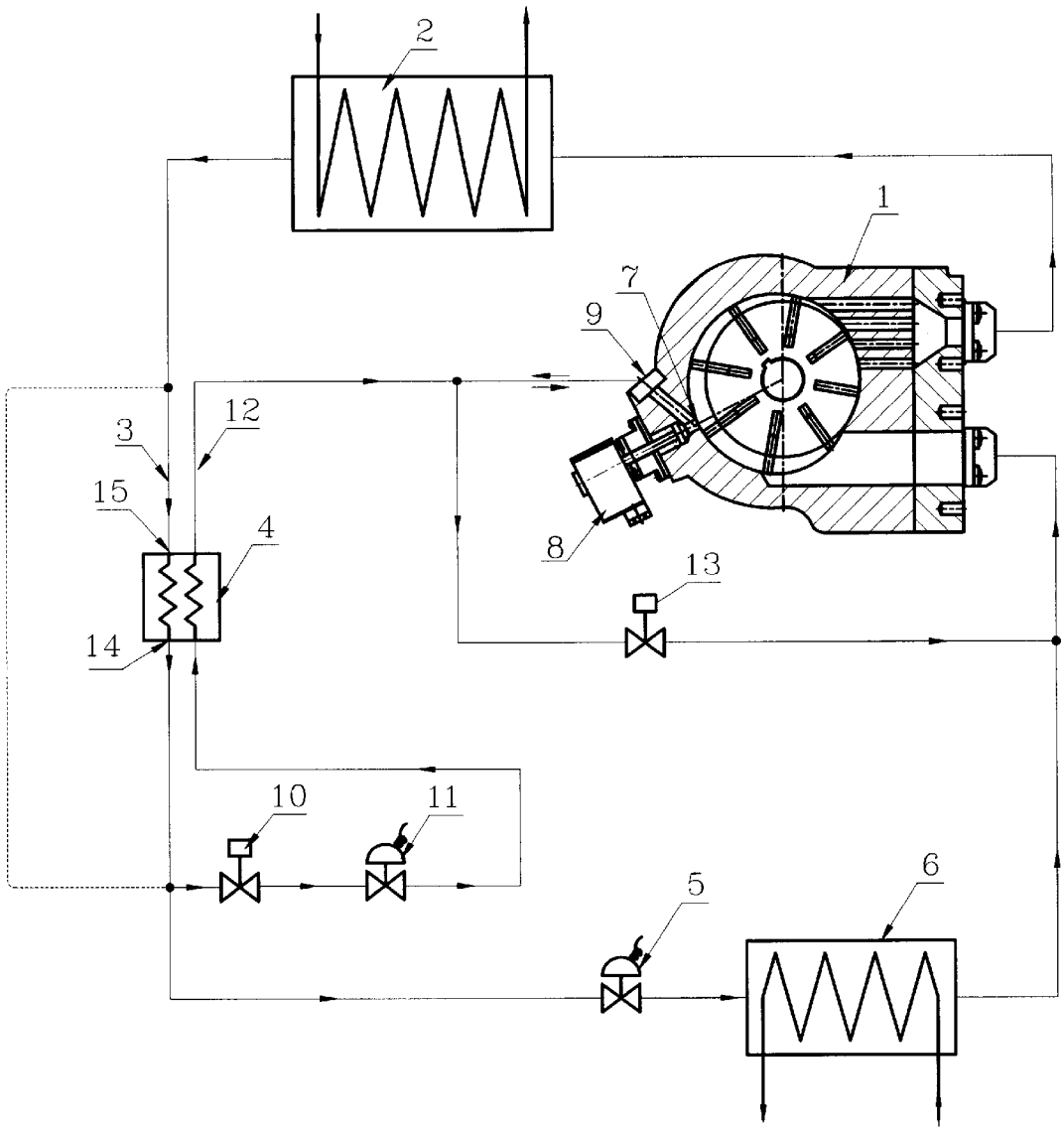
FIGURE 1: REFRIGERATION SYSTEM

CAPACITY CONTROL OF REFRIGERATION SYSTEMS

CROSS-REFERENCE TO RELATED APPLICATION

This application is a continuation-in-part of the patent application "Capacity Control of Compressors" Ser. No. 09/526,453 dated Mar. 16, 2000.

FIELD OF THE INVENTION

The invention relates to refrigeration systems using unloading rotary compressors.

BACKGROUND OF THE INVENTION

The main problem of controlling compression system capacity is to reduce both the capacity of the compressor and the power required to drive the compressor rotor to the same extent.

One commonly utilized means of achieving a capacity reduction is to bypass a portion of the fluid from the discharge side of the compressor back to the suction side. This method requires an auxiliary pipe connecting the discharge and suction sides of the compressor with a valve located in the pipe. Such an arrangement reduces the system capacity since a smaller amount of fluid is directed to the main system circuit, but it does not reduce the power consumption since the compressor pumps the same amount of fluid.

On the other hand, in many refrigeration or refrigerant compression applications, there are other times when it would be more desirable to have the ability to also achieve increased capacity. One way of achieving increased capacity is the inclusion of an economizer circuit into the refrigerant system. Typically, the economizer fluid is injected through an economizer port at a point after the compression chambers have been closed.

In one design, the system is provided with an unloader valve which selectively communicates the economizer injection line back to suction. In this arrangement, the fluid ports and passages necessary to achieve the economizer injection are also utilized to achieve suction bypass unloading, and thus the compressor and system design and construction are simplified. However, operating in regular mode, the compressor chamber communicates with the additional volume of the passages, thus impacting compressor efficiency. If the passages are made too small to reduce the impact on compressor efficiency, unloading capacity would not be enough.

As a further development a pulsed flow capacity control is achieved by rapidly cycling solenoid valves in the suction line, the economizer circuit, and in a bypass line with the percent of "open" time for the valve regulating the rate of flow. The provision of three modulating valves results in an increased complexity and a reduced reliability of the whole refrigeration system.

SUMMARY OF THE INVENTION

The present invention is directed to a method of reducing cooling capacity in a refrigeration system with a rotary compressor in such a way that the power requirement to drive the rotor is reduced to the same extent (or close to) as capacity is reduced. In an aspect of the invention this is accomplished without any impact on compressor efficiency at regular mode. In another aspect, this is accomplished without excessive complexity or low reliability.

The present invention provides a refrigeration system comprising a main circuit, and a bypass circuit. The main circuit comprises, in a closed loop, a compressor, a condenser unit, an expansion device, an evaporator unit, connecting piping and appropriate refrigeration control. The compressor includes a housing, an inlet, an outlet, a compression region therebetween, an economizer port located in the compression region at a point where the port is in communication with the compression chamber after it has been closed for compression, and a variable flow valve associated with the economizer port. A body of the valve is a part of a body of the housing and a seat of the valve in a closed position is shaped to be contiguous with internal portion of the housing. The bypass circuit has a second solenoid valve located between the economizer port and the suction side of the compressor. The variable flow valve, a control system, and a transducer, reading parameters associated with a system capacity demand, are wired in an electrical circuit. The control system activates the valves based on the capacity demand.

One more aspect of the invention there is provided a refrigeration system comprising a main circuit, and an economizer circuit. The main circuit comprises, in a closed loop, a compressor, a condenser unit, an expansion device, an evaporator unit, connecting piping and appropriate refrigeration control. The compressor includes a housing, an inlet, an outlet, a compression region therebetween, an economizer port located in the compression region at a point where the port is in communication with the compression chamber after it has been closed for compression, and a variable flow valve associated with the economizer port. A body of the valve is a part of a body of the housing and a seat of the valve in a closed position is shaped to be contiguous with internal portion of the housing. The economizer circuit includes a first solenoid valve, an additional expansion device and an economizing heat exchanger and is connected to the economizer port. The economizing heat exchanger provides thermal contact between refrigerant in the main circuit after the condenser unit and evaporating refrigerant in the economizer circuit after the additional expansion device. The variable flow valve, a control system, and a transducer, reading parameters associated with a system capacity demand, are wired in an electrical circuit. The control system activates the valves based on the capacity demand.

When the economizer and bypass circuits are applied together the refrigeration system includes a first solenoid valve in the bypass circuit and a second solenoid valve in the economizer circuit.

According to the invention the refrigeration system has an advantage in terms of the system simplicity and reliability since only one variable flow valve is required.

BRIEF DESCRIPTION OF THE DRAWINGS

Preferred embodiments of the present invention are illustrated in the attached drawing, which is:

The FIGURE is a schematic diagram of a Refrigeration System utilizing capacity control.

DETAILED DESCRIPTION OF THE PREFERRED EMBODIMENTS

A refrigeration system, realizing abilities to increase and decrease capacity, consists of three circuits: a main circuit, an economizer circuit for the increased capacity mode, and a bypass circuit for the decreased capacity mode.

The main circuit includes a compressor 1, a condenser 2, a high pressure side 3 of a regenerative heat exchanger 4, an expansion valve 5, and an evaporator 6. The compressor 1 has the economizer port 7, the variable flow (including a solenoid type) valve 8, and the outlet 9. A seat of the valve 8 in a closed position is shaped to be contiguous with the wall portion of the compression chamber.

The compressor could be provided with a plurality of the economizer ports and seats providing contiguous shape of seats providing contiguous shape of seats in respect to the wall portion of the compression chamber.

The economizer circuit includes a solenoid valve 10, an auxiliary expansion valve 11, and a low pressure side 12 of the regenerative heat exchanger 4.

The bypass circuit includes a solenoid valve 13.

Both economizer and bypass loops, communicate with the economizer port 7 over the valve 8 and outlet 9 at one end. The economizer circuit at the other end is connected either to an outlet 14 of the high pressure side 3 of the regenerative heat exchanger 4 or, as an option, to an inlet 15 of the high pressure side 3 of the regenerative heat exchanger 4. The bypass loop circuit at the other end is connected to the compressor suction line.

In the regular mode the valves 8, 10 and 14 are closed and the refrigeration system operates as follows. The compressor 1 induces vapor at low pressure from the evaporator 6, compresses it to high pressure, and discharges the compressed vapor into condenser 2. In the condenser vapor is liquefied. Liquid refrigerant after the condenser 2 passes the high pressure side 3 of the regenerative heat exchanger 4, expands in the expansion valve 5 from high pressure to low pressure turning the liquid into a mixture of vapor and liquid, and enters the evaporator 6. In the evaporator 6, the liquid phase of the mixture is boiled out, absorbing heat from objects to be cooled. Vapor, appearing at the evaporator outlet, is induced by the compressor and the thermodynamic cycle is reproduced.

In the increased capacity mode, the valves 8 and 10 are opened and the valve 13 is closed. In this mode a part of refrigerant flow at the outlet 14 (or at the inlet 15 as shown with a dashed line) of the regenerative heat exchanger 4 is expanded in the expansion valve 11 from high pressure to low pressure turning the liquid to a mixture of vapor and liquid. Then the mixture enters the low pressure side 12 of the regenerative heat exchanger 4. In the heat exchanger 4 the liquid phase is boiled out, subcooling liquid refrigerant flow in the high pressure side 3. Vapor, appearing at the heat exchanger outlet 14, is introduced into compression process over the economizer port 7 without any effect on refrigerant flow induced by the compressor 1 from the suction line. This additional subcooling increases total cooling capacity.

If the valve 8 is a solenoid one, then the system generates two levels of system capacity: a nominal capacity, when the valve is closed, and a maximal capacity, when the valve is opened.

If the valve 8 is a control valve, then the system generates any intermediate capacity from the nominal one, when the valve is completely closed, to the maximal one, when the valve is completely opened. The intermediate capacity between the nominal and maximal ones is provided at intermediate positions of the valve seat depending on the capacity demand.

If the valve 8 is a pulsing one, then the system generates any intermediate capacity from the nominal one, when the valve is closed for the full pulsing cycle, to the maximal one, when the valve is opened for the full pulsing cycle. The intermediate capacity between the nominal and maximal ones is provided by the relation between the time or portion of the pulsing cycle when the valve seat is at an opened position, to the time or portion of the pulsing cycle when the valve seat is at a closed position, depending on the capacity demand.

In the decreased capacity mode the valve 10 is closed and the valves 8 and 13 are opened. In this mode a part of the refrigerant flow from the economizer port 7 is returned back to the suction line, decreasing the amount of refrigerant circulating over the main circuit.

If the valve 8 is a solenoid one, then the system generates two levels of system capacity: a nominal capacity, when the valve is closed, and a minimal capacity, when the valve is opened.

If the valve 8 is a control valve, then the system generates any intermediate capacity from the nominal one, when the valve is closed, to the minimal one, when the valve is opened. The intermediate capacity between the nominal and maximal ones is provided at intermediate positions of the valve seat depending on the capacity demand.

If the valve 8 is a pulsing one, then the system generates any intermediate capacity from the nominal one, when the valve is closed for the full pulsing cycle, to the minimal one, when the valve is opened for the full pulsing cycle. The intermediate capacity between the nominal and maximal ones is provided by the relation between the time or portion of the pulsing cycle when the valve seat is at an opened position, to the time or portion of the pulsing cycle when the valve seat is at a closed position, depending on the capacity demand.

If a transcritical refrigerant (such as carbon dioxide) is applied, than instead of the condenser 2, a gas cooler is applied since instead of the condensation process the transcritical heat rejection process takes place.

The refrigeration system described above has only one variable flow valve, which is an advantage in terms of the system simplicity and reliability.

While certain preferred embodiments of the present invention have been disclosed in detail, it is to be understood that various modifications in its structure may be adopted without departing from the spirit of the invention or the scope of the following claims

I claim:

1. A refrigeration system comprising:

(a) a compressor unit including a housing, a suction side and a discharge side, an economizer port located at a point after the compression chambers have been closed for compression; a variable flow valve associated with said economizer port, which in an opened position provides communication between said compression chamber and an external outlet of said economizer port over said economizer port; a body of said valve being a part of a body of said housing and a seat of said valve in a closed position is shaped to be contiguous with internal portion of said housing;

(b) a closed main circuit including said compressor, a condenser unit, an expansion device, an evaporator unit, connecting piping and appropriate refrigeration control;

(c) a bypass circuit between said external outlet and said suction side; and (d) an electrical circuit including said variable flow valve, a control system, and a transducer reading parameters associated with a system capacity demand.

2. A refrigeration system as recited in claim 1 wherein said compressor unit is a rotary vane compressor unit.

3. A refrigeration system as recited in claim 1 wherein said condenser unit is a gas cooler unit providing transcritical heat rejection.

4. A refrigeration system as recited in claim 1 wherein said port and said seat of said variable flow valve consists of plurality of ports and seats.

5. A refrigeration system as recited in claim 1 wherein said variable flow valve is a solenoid valve.

6. A refrigeration system as recited in claim 1 wherein said variable flow valve is a control valve.

7. A refrigeration system as recited in claim 1 wherein said variable flow valve is a pulsing valve.

8. A refrigeration system as recited in claim 1 wherein said transducer is a refrigerant pressure transducer.

9. A refrigeration system as recited in claim 1 wherein said transducer is a temperature transducer.

10. A refrigeration system comprising:

(a) a compressor unit including a housing, a suction side and a discharge side, an economizer port located at a point after the compression chambers have been closed for compression; a variable flow valve associated with said economizer port, which in an opened position provides communication between said compression chamber and an external outlet of said economizer port over said economizer port; a body of said valve being a part of a body of said housing and a seat of said valve in a closed position is shaped to be contiguous with internal portion of said housing;

(b) a closed main circuit including said compressor, a condenser unit, an expansion device, an evaporator unit, connecting piping and appropriate refrigeration control;

(c) an economizer circuit between said discharge side after said condenser unit and said external outlet including an additional expansion device and an economizing heat exchanger therebetween; said economizing heat exchanger providing thermal contact between refrigerant flow in said main circuit after said condenser unit and between evaporating refrigerant in said economizer circuit after said additional expansion device;

(d) an electrical circuit including said variable flow valve, a control system, and a transducer reading parameters associated with a system capacity demand.

11. A refrigeration system as recited in claim 10 wherein said compressor unit is a rotary compressor unit.

12. A refrigeration system as recited in claim 10 wherein said condenser unit is a gas cooler unit providing transcritical heat rejection.

13. A refrigeration system as recited in claim 10 wherein said port and said seat of said variable flow valve consists of plurality of ports and seats.

14. A refrigeration system as recited in claim 10 wherein said variable flow valve is a solenoid valve.

15. A refrigeration system as recited in claim 10 wherein said variable flow valve is a control valve.

16. A refrigeration system as recited in claim 10 wherein said variable flow valve is a pulsing valve.

17. A refrigeration system as recited in claim 10 wherein said transducer is a refrigerant pressure transducer.

18. A refrigeration system as recited in claim 10 wherein said transducer is a temperature transducer.

19. A refrigeration system as recited in claim 10 wherein said refrigeration system further includes a first solenoid valve in said bypass circuit, an economizer circuit between said discharge side after said condenser unit and said external outlet including a second solenoid valve, an additional expansion device and an economizing heat exchanger therebetween; said economizing heat exchanger providing thermal contact between refrigerant flow in said main circuit after said condenser unit and between evaporating refrigerant in said economizer circuit after said additional expansion device; said first and second solenoid valves are electrically connected to a control system.

20. A refrigeration system as recited in claim 19 wherein said compressor unit is a rotary compressor unit.

21. A refrigeration system as recited in claim 19 wherein said condenser unit is a gas cooler unit providing transcritical heat rejection.

22. A refrigeration system as recited in claim 19 wherein said port and said seat of said variable flow valve consists of plurality of ports and seats.

23. A refrigeration system as recited in claim 19 wherein said variable flow valve is a solenoid valve.

24. A refrigeration system as recited in claim 19 wherein said variable flow valve is a control valve.

25. A refrigeration system as recited in claim 19 wherein said variable flow valve is a pulsing valve.

26. A refrigeration system as recited in claim 19 wherein said transducer is a refrigerant pressure transducer.

27. A refrigeration system as recited in claim 19 wherein said transducer is a temperature transducer.

* * * * *